US009427611B1

(12) United States Patent
Balentine

(10) Patent No.: US 9,427,611 B1
(45) Date of Patent: Aug. 30, 2016

(54) ADJUSTABLE MOUNT PULL-UP BAR

(71) Applicant: Franklin A Balentine, Wilmington, NC (US)

(72) Inventor: Franklin A Balentine, Wilmington, NC (US)

( * ) Notice: Subject to any disclaimer, the term of this patent is extended or adjusted under 35 U.S.C. 154(b) by 0 days.

(21) Appl. No.: 14/687,961

(22) Filed: Apr. 16, 2015

(51) Int. Cl.

| | |
|---|---|
| ***A63B 1/00*** | (2006.01) |
| ***A63B 21/00*** | (2006.01) |
| ***A63B 21/068*** | (2006.01) |
| ***A63B 21/16*** | (2006.01) |

(52) U.S. Cl.
CPC ..... *A63B 1/00* (2013.01); *A63B 21/00047* (2013.01); *A63B 21/068* (2013.01); *A63B 21/1469* (2013.01); *A63B 21/16* (2013.01); *A63B 2021/169* (2013.01)

(58) Field of Classification Search
CPC A63B 1/00; A63B 23/1218; A63B 21/4035; A63B 21/068; A63B 2210/50; A63B 21/00047; A63B 23/1227; A63B 21/1636; A63B 2225/093; A63B 3/00; A63B 21/1645; A63B 2225/09; A63B 23/12; A63B 21/1627; A63B 21/169; A63B 23/1209
USPC ..... 482/38–42, 143; D21/673, 679, 686, D21/662
See application file for complete search history.

(56) References Cited

U.S. PATENT DOCUMENTS

| | | | | |
|---|---|---|---|---|
| 4,111,414 | A * | 9/1978 | Roberts | A63B 1/00 482/102 |
| 4,662,629 | A * | 5/1987 | Plovie | A63B 21/00047 182/206 |
| 5,046,722 | A * | 9/1991 | Antoon | A63B 17/00 482/39 |
| 5,626,546 | A * | 5/1997 | Little | A63B 21/0552 482/123 |
| 6,416,447 | B1 * | 7/2002 | Harmon | A63B 21/0023 482/121 |
| 6,508,743 | B1 * | 1/2003 | Fortin | A63B 1/00 482/38 |
| 7,066,866 | B1 * | 6/2006 | Mobley | A63B 1/00 482/40 |
| D623,707 | S * | 9/2010 | Ritchie | D21/679 |
| 7,837,598 | B1 * | 11/2010 | Boozel, Jr. | A63B 21/151 482/38 |

(Continued)

*Primary Examiner* — Loan H Thanh
*Assistant Examiner* — Andrew S Lo
(74) *Attorney, Agent, or Firm* — Luedeka Neely Group, P.C.; Rick Barnes

(57) ABSTRACT

An adjustable mount pull-up bar. A first strut has a mounting plate at one end and an attachment point at the other end, with an offset between the two ends. A second strut is similarly constructed, but the offset of the first strut is a mirror image of the offset of the second strut. A bar has two attachment points to connect to either of the first and second struts. When the struts are connected to the bar in one orientation, the mounting plates at the ends of the struts are relatively closer together, and when the struts are connected to the bar in a second orientation, the mounting plates at the ends of the struts are relatively farther apart. This enables the pull-up bar to be mounted, for example, to wall studs or ceiling joists that are disposed at different distances from each other.

20 Claims, 5 Drawing Sheets

(56) References Cited

U.S. PATENT DOCUMENTS

D633,156 S * 2/2011 Caswell ..... D21/679
D633,961 S * 3/2011 Loew ..... D21/679
D650,024 S * 12/2011 Ivanov ..... D21/662
D667,901 S * 9/2012 Garcia Chavez ..... D21/679
D682,955 S * 5/2013 Stephan ..... D21/679
D686,286 S * 7/2013 Orakwusi ..... D21/679
8,808,147 B2 * 8/2014 Gillespie ..... A63B 1/00 482/37
2004/0048723 A1 * 3/2004 Parrilla ..... A63B 21/072 482/94
2005/0250619 A1 * 11/2005 Daikeler ..... A63B 1/00 482/40
2005/0272574 A1 * 12/2005 Lessard ..... A63B 21/078 482/104
2011/0172071 A1 * 7/2011 Piane, Jr. ..... A63B 22/18 482/142
2011/0245040 A1 * 10/2011 Skipper ..... A63B 9/00 482/38
2011/0281696 A1 * 11/2011 Cuadrado ..... A63B 69/205 482/87
2012/0046150 A1 * 2/2012 Stacey ..... A63B 1/00 482/131
2012/0115683 A1 * 5/2012 Ross ..... A63B 21/1636 482/38
2012/0115684 A1 * 5/2012 Nguyen ..... A63B 23/1218 482/40
2013/0178338 A1 * 7/2013 Ross ..... A63B 1/00 482/40
2013/0184124 A1 * 7/2013 Reed ..... A63B 69/0048 482/37
2013/0244836 A1 * 9/2013 Maughan ..... A63B 21/1645 482/40
2014/0094347 A1 * 4/2014 Orakwusi ..... A63B 21/1469 482/38
2014/0221163 A1 * 8/2014 McBride ..... A63B 69/0048 482/40
2014/0302968 A1 * 10/2014 Velikin ..... A63B 1/00 482/40
2015/0005142 A1 * 1/2015 Crisp ..... A63B 21/055 482/129
2015/0290488 A1 * 10/2015 Hopperstad ..... A63B 21/078 482/38

* cited by examiner

ADJUSTABLE MOUNT PULL-UP BAR

FIELD

This invention relates to the field of exercise equipment. More particularly, this invention relates to a mountable pull-up bar.

INTRODUCTION

A properly shaped pull-up bar can dramatically enhance muscle building and muscle tone in comparison to a straight bar. For example, a properly shaped pull-up bar provides inherent assistance with the proper spacing and positioning of the hands. Further, the shape of the pull-up bar can assist with the proper hand orientation, which can both enhance the effectiveness of the workout and reduce the probability of injury.

However, issues such as those described above can be moot if the pull-up bar is not securely retained in a proper position during use. While a variety of different mounting systems have been used, many of these systems either are not sufficiently secure as to prevent failure and injury, or interfere with the proper shape of the bar.

What is needed, therefore, is a mountable pull-up bar that reduces issues such as those described above, at least in part.

SUMMARY OF THE CLAIMS

The above and other needs are met by an adjustable mount pull-up bar. A first strut has a mounting plate at one end and an attachment point at the other end, with an offset between the two ends. A second strut is similarly constructed, but the offset of the first strut is a mirror image of the offset of the second strut. A bar has two attachment points to connect to either of the first and second struts. When the struts are connected to the bar in one orientation, the mounting plates at the ends of the struts are relatively closer together, and when the struts are connected to the bar in a second orientation, the mounting plates at the ends of the struts are relatively farther apart. This enables the pull-up bar to be mounted, for example, to wall studs or ceiling joists that are disposed at different distances from each other.

In various embodiments according to this aspect of the invention, the bar is a shaped bar that is configured to be placed in a proper orientation. In some embodiments, the first and second struts when attached to the bar depend substantially vertically upwards and at substantially right angles from the bar when the bar is in the proper orientation. In some embodiments, the first and second struts when attached to the bar depend substantially horizontally outwards at substantially right angles from the bar when the bar is in the proper orientation.

In some embodiments, a first hand-hold is connected to the first strut near the second end, with the first hand-hold disposed so as to be substantially linear with the first strut. In some embodiments, a second hand-hold is connected to the second strut near the second end, the second hand-hold disposed so as to be substantially linear with the second strut.

In some embodiments, a first hand-hold is connected to the first strut near the second end, where the first hand-hold is disposed so as to be substantially perpendicular to the first strut. In some embodiments, a second hand-hold is connected to the second strut near the second end, where the second hand-hold is disposed so as to be substantially perpendicular to the second strut.

In some embodiments, the linear offsets of the first and second struts are configured as curved inflections along the lengths of the first and second struts. In some embodiments, the linear offsets of the first and second struts are configured as angular bends along the lengths of the first and second struts. In some embodiments, the mounting plates are flat plates having holes formed therein for receiving fasteners. In some embodiments, the bar is substantially covered along its length with a cushioning material.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 4:
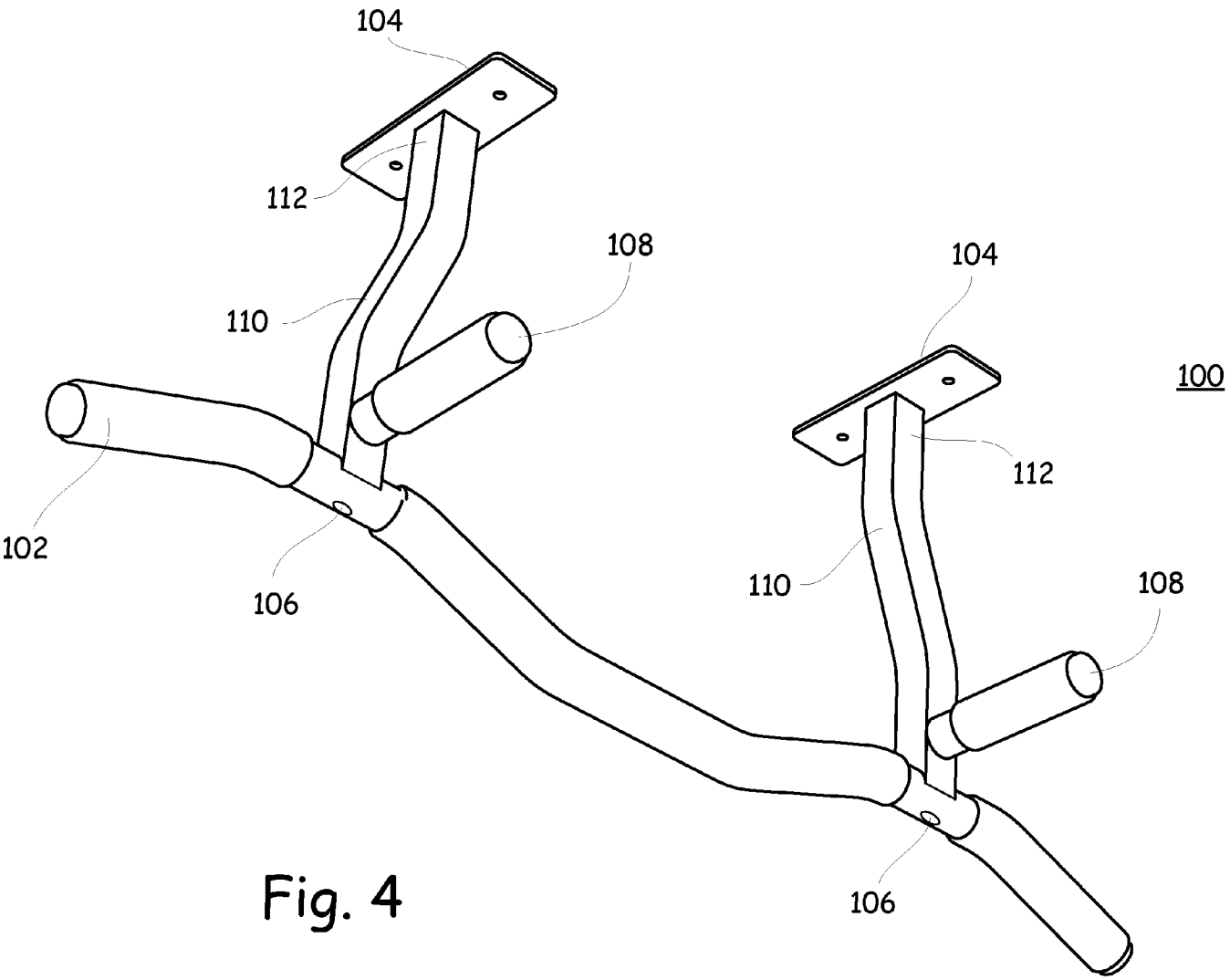
FIG. 4 is a perspective view of an adjustable ceiling mount pull-up bar in a first configuration according to an embodiment of the present invention.
Figure 5:
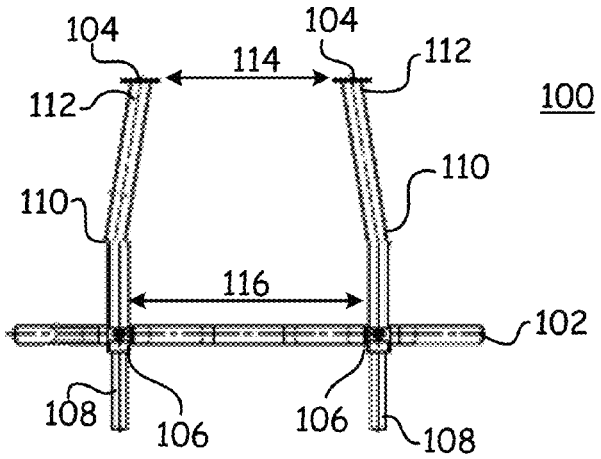
FIG. 5 is a top view of an adjustable wall mount pull-up bar in a first configuration according to an embodiment of the present invention.
Figure 6:
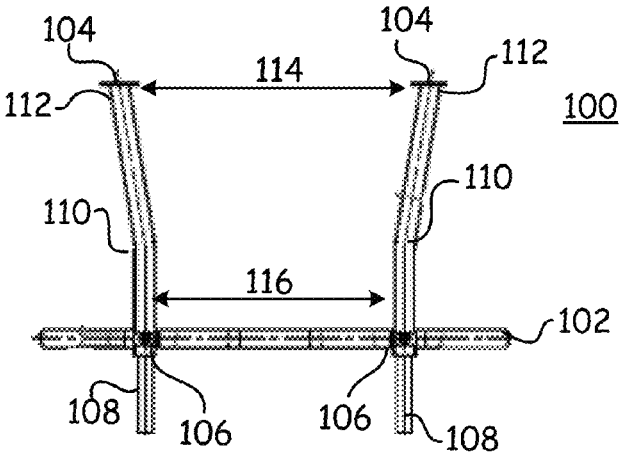
FIG. 6 is a top view of an adjustable wall mount pull-up bar in a second configuration according to an embodiment of the present invention.
Figure 7:
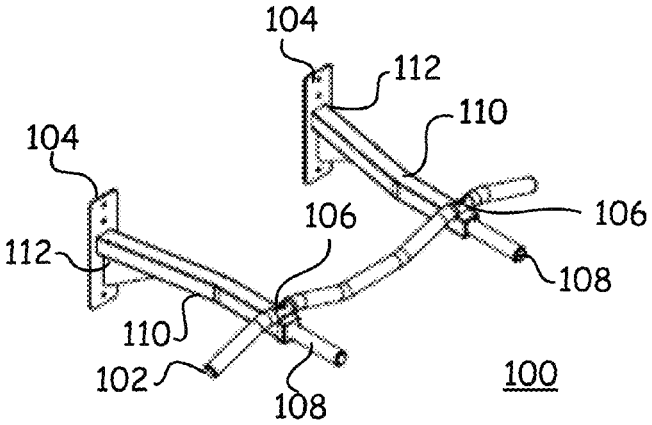
FIG. 7 is a perspective view of an adjustable wall mount pull-up bar in a second configuration according to an embodiment of the present invention.

With reference now to the figures, there are depicted various embodiments of the adjustable mount pull-up bar 100. FIGS. 1-5 depicts various configurations and views of an adjustable ceiling mount pull-up bar 100, and FIGS. 6-8 depict various configurations and views of an adjustable wall mount pull-up bar 100.

In all of the embodiments depicted, the pull-up bar 100 includes two interchangeable struts 112 and a bar 102. The struts 112 each have a first connection point on a first end that is attachable to the bar 102 at connection points 106, and a mounting plate 104 on a second end that is attachable to the structure of a building, such as ceiling joists or wall studs. Either strut 112 can be attached at its first end to either of the two attachment positions 106 on the bar 102.

Figure 1:
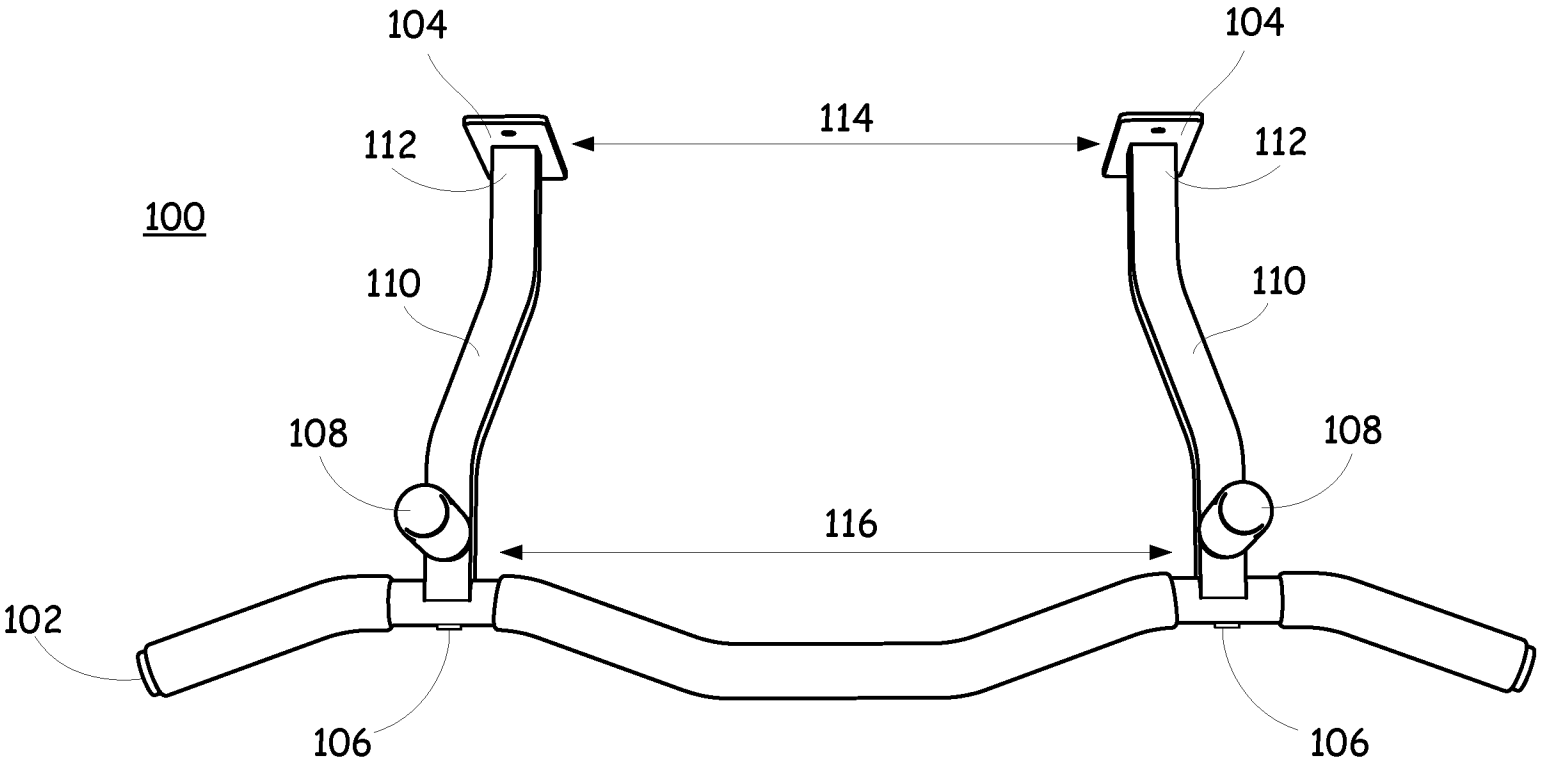
FIG. 1 is a front view of an adjustable ceiling mount pull-up bar in a first configuration according to an embodiment of the present invention.
Figure 2:
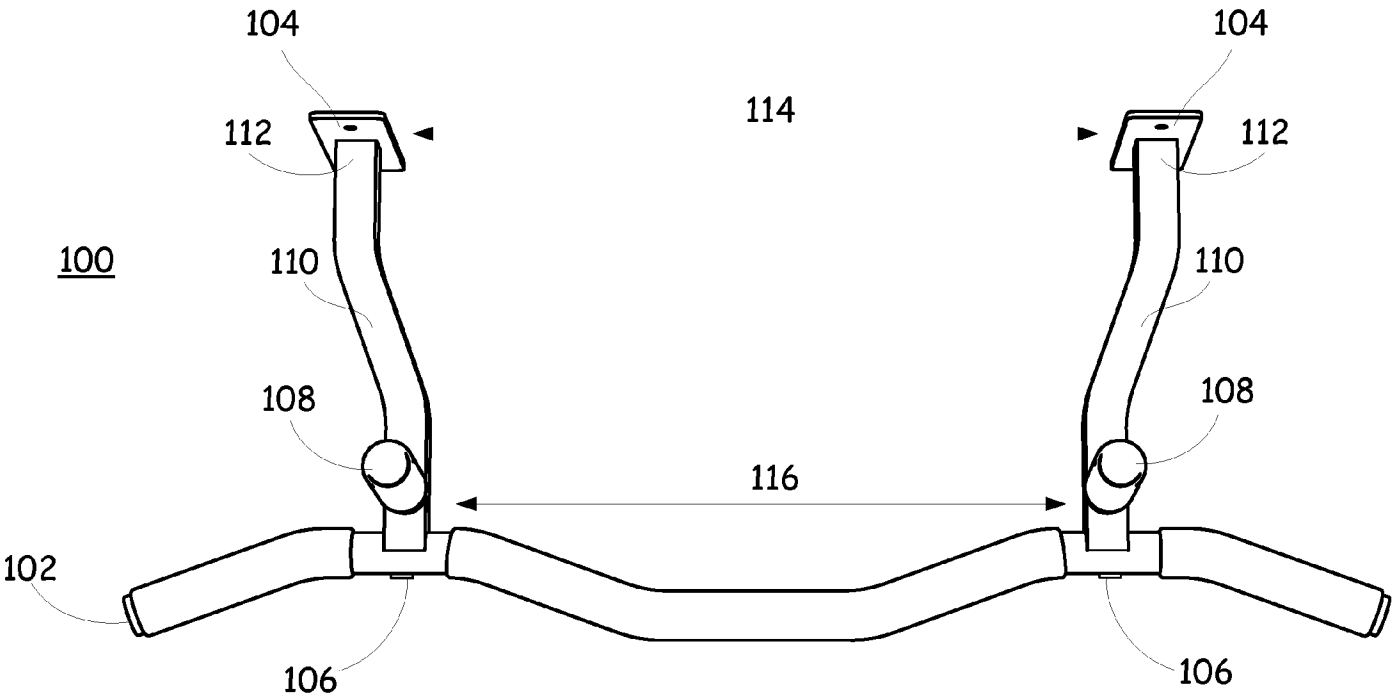
FIG. 2 is a front view of an adjustable ceiling mount pull-up bar in a second configuration according to an embodiment of the present invention.
Figure 3:
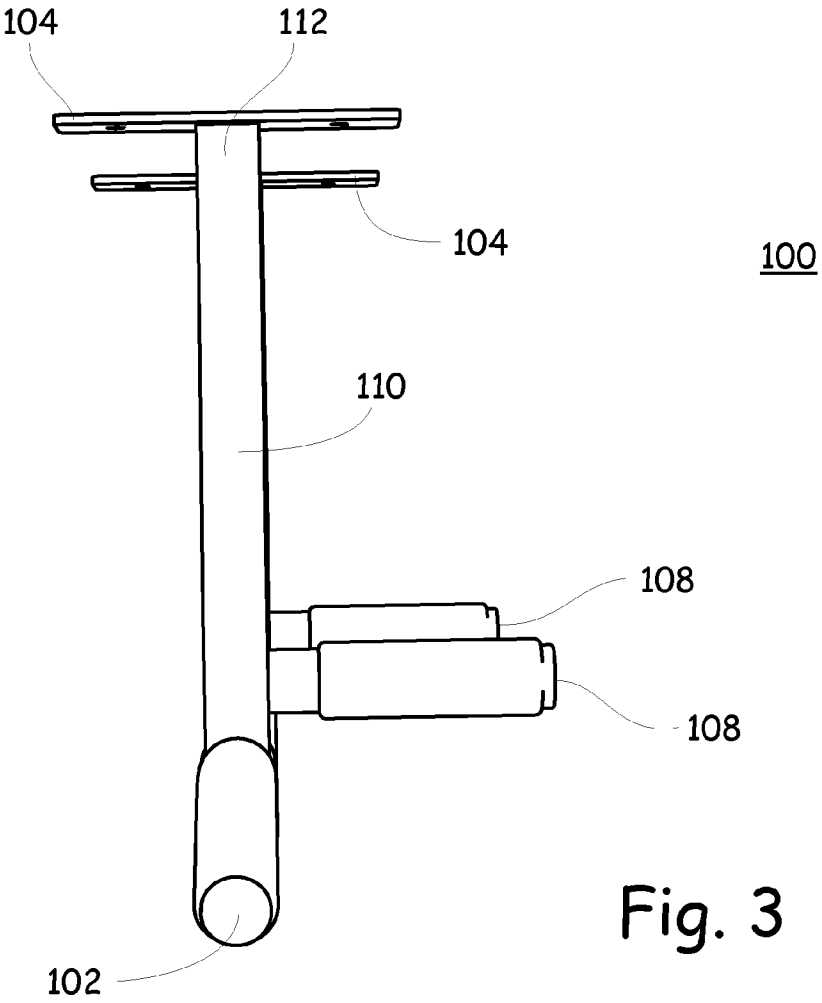
FIG. 3 is a side view of an adjustable ceiling mount pull-up bar according to an embodiment of the present invention.

Each strut 112 includes an inflection 110 along its length that provides a linear offset between its two ends. When the struts 112 are mounted to the bar 102 in a first configuration, such as is depicted in FIGS. 1 and 4-5, the inflections 110 cause the spacing 114 between the mounting plates 104 (which are mountable to the building structure, such as the ceiling or the wall) to be less than the spacing 116 between the first connection points (which are mounted to the bar 102 at positions 106). When the struts 112 are mounted to the bar 102 in a second configuration (with the struts 112 swapped from the first configuration) as depicted in FIGS. 2 and 6-7, the inflections 110 cause the spacing 114 between the mounting plates 104 to be greater than the spacing 116 between the first connection points.

In this manner, the struts 112 can be selectively mounted to the bar 102 in a configuration that disposes the mounting plates 104 at a spacing that matches the building structure, such as joists in the ceiling or studs in the wall. If the building structure has a relatively narrower spacing, then the struts 112 can be mounted on the bar 102 in the first configuration, such that the mounting plates 104 are relatively closer together, and if the building structure has a relatively wider spacing, then the struts 112 can be mounted on the bar 102 in the second configuration, such that the mounting plates 104 are relatively farther apart.

In one embodiment, the two connection points 106 on the bar 102 are spaced twenty inches apart, and each strut 112 has a two inch linear offset in the inflection 110. Thus, when the struts 112 are mounted to the bar 102 in the first configuration, with the inflections 110 sweeping inward from the connection points 106, the mounting plates 104 on the struts 112 are disposed sixteen inches apart, which matches the spacing between the joists or studs in some structures.

However, when the struts 104 are mounted to the bar 102 in the second configuration, with the inflections sweeping outward from the connection points 106, the mounting plates 104 on the struts 112 are disposed twenty-four inches apart, which matches the spacing between the joists or studs in other structures. Other spacings of the connection points 106 and inflection offsets 110 are also contemplated. In some embodiments, such as depicted in FIGS. 1-5, the offsets 110 are configured as curved inflections in the struts 112. In other embodiments, such as depicted in FIGS. 6-8, the offsets 110 are configured as angular bends in the struts 112.

In some embodiments the bar 102 is configured as an ergonomic or shaped pull-up bar 102. In some embodiments the bar 102 is padded, such as with foam or rubber, or some other cushioning material.

In some embodiments hand-holds 108 are attachable to the struts 108. In one embodiment, as depicted in FIGS. 1-5, the hand-holds 108 are disposed so as to extend out in a perpendicular manner from the struts 112. In another embodiments, as depicted in FIGS. 6-8, the hand-holds 108 are disposed so as to extend out in a linear manner from the struts 112. The offsets 110 in the swappable struts 112 enable the hand-holds 108 to be maintained at the desired distance 116 between the connection points 106 regardless of the spacing 114 that is desired to match the building structure.

In various embodiments the struts 112 and bar 102 are formed of a relatively lightweight, strong, and rigid material, such as either hollow or solid tubes of steel, titanium, aluminum, magnesium, or a composite material. The connections between the struts 112 and the bar 102 can be formed such as by pin and slot connections or nut and bolt connections. In some embodiments, the mounting plates 104 are welded to the struts 112. In some embodiment that two struts 112 are identical, on to another, but one of the struts 112 is mounted backward in relation to the other, thus providing the mirror-image arrangement of the offsets 110. In some of those embodiments, the hand-holds 108 can be mounted on either side of the struts 112, such as by being screwed into a threaded hole, where such a threaded hole is provided on both sides of the second end of the struts 112. In other embodiments, the hand-holds 108 are welded onto the struts 112.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An adjustable mount pull-up bar, comprising:

a first strut having first and second distal ends, with a first mounting plate attached to the first end, a first strut attachment point disposed at the second end, and configured with a linear offset between the first and second ends;

a second strut having first and second distal ends, with a second mounting plate attached to the first end, a second strut attachment point disposed at the second end, and configured with a linear offset between the first and second ends;

wherein the linear offset of the first strut is configured as a mirror image of the linear offset of the second strut when the first and second struts are laid side by side;

a bar having first and second bar attachment points, each of the first and second bar attachment points adapted to connect to either of the first and second strut attachment points;

wherein when the first strut attachment point of the first strut is connected to the bar at the first bar attachment point and the second strut attachment point of the second strut is connected to the bar at the second bar attachment point, the first mounting plate is disposed at a first distance from the second mounting plate; and when the first strut attachment point of the first strut is connected to the bar at the second bar attachment point and the second strut attachment point of the second strut is connected to the bar at the first bar attachment point, the first mounting plate is disposed at a second distance from the second mounting plate, which second distance is greater than the first distance.

2. The adjustable mount pull-up bar of claim 1, wherein the bar is a shaped bar.

3. The adjustable mount pull-up bar of claim 1, wherein the bar is a shaped bar, and the first and second struts when attached to the bar are positioned substantially vertically upwards and at substantially right angles from the bar.

4. The adjustable mount pull-up bar of claim 1, wherein the bar is a shaped bar, and the first and second struts when attached to the bar are positioned substantially horizontally outwards at substantially right angles from the bar.

5. The adjustable mount pull-up bar of claim 1, further comprising a first hand-hold connected to the first strut near the second end, the first hand-hold disposed so as to be substantially linear with the first strut.

6. The adjustable mount pull-up bar of claim 1, further comprising a first hand-hold connected to the first strut near the second end, the first hand-hold disposed so as to be substantially perpendicular to the first strut.

7. The adjustable mount pull-up bar of claim 1, wherein the linear offsets of the first and second struts are configured as curved inflections along the lengths of the first and second struts.

8. The adjustable mount pull-up bar of claim 1, wherein the linear offsets of the first and second struts are configured as angular bends along the lengths of the first and second struts.

9. The adjustable mount pull-up bar of claim 1, wherein the mounting plates are flat plates having holes formed therein for receiving fasteners.

10. The adjustable mount pull-up bar of claim 1, wherein the bar is substantially covered along its length with a cushioning material.

11. An adjustable mount pull-up bar, comprising:

a first strut having first and second distal ends, with a first mounting plate attached to the first end, a first strut attachment point disposed at the second end, and configured with a linear offset between the first and second ends;

a first hand-hold connected to the first strut near the second end, the first hand-hold disposed so as to be substantially perpendicular to the first strut;

a second strut having first and second distal ends, with a second mounting plate attached to the first end, a second strut attachment point disposed at the second end, and configured with a linear offset between the first and second end;

a second hand-hold connected to the second strut near the second end, the second hand-hold disposed so as to be substantially perpendicular to the second strut;

wherein the linear offset of the first strut is configured as a mirror image of the linear offset of the second strut when the first and second struts are laid side by side;

a shaped bar, the bar having first and second bar attachment points, each of the first and second bar attachment points adapted to connect to either of the first and second strut attachment points;

wherein the first and second struts when attached to the bar are positioned substantially vertically upwards and at substantially right angles from the bar, when the first strut attachment point of the first strut is connected to the bar at the first bar attachment point and the second strut attachment point of the second strut is connected to the bar at the second bar attachment point, the first mounting plate is disposed at a first distance from the second mounting plate; and when the first strut attachment point of the first strut is connected to the bar at the second bar attachment point and the second strut attachment point of the second strut is connected to the bar at the first bar attachment point, the first mounting plate is disposed at a second distance from the second mounting plate, which second distance is greater than the first distance.

12. The adjustable mount pull-up bar of claim 11, wherein the linear offsets of the first and second struts are configured as a curved inflection along the lengths of the first and second struts.

13. The adjustable mount pull-up bar of claim 11, wherein the linear offsets of the first and second struts are configured as an angular bend along the lengths of the first and second struts.

14. The adjustable mount pull-up bar of claim 11, wherein the first distance between the mounting plates is configured to match a first standardized distance between ceiling joists.

15. The adjustable mount pull-up bar of claim 11, wherein the second distance between the mounting plates is configured to match a second standardized distance between ceiling joists, which second standardized distance is greater than the first standardized distance.

16. An adjustable mount pull-up bar, comprising:

a first strut having first and second distal ends, with a first mounting plate attached to the first end, a first strut attachment point disposed at the second end, and configured with a linear offset between the first and second ends;

a first hand-hold connected to the first strut near the second end, the first hand-hold disposed so as to be substantially linear with the first strut;

a second strut having first and second distal ends, with a second mounting plate attached to the first end, a second strut attachment point disposed at the second end, and configured with a linear offset between the first and second ends;

a second hand-hold connected to the second strut near the second end, the second hand-hold disposed so as to be substantially linear with the second strut;

wherein the linear offset of the first strut is configured as a mirror image of the linear offset of the second strut when the first and second struts are laid side by side; and a shaped bar having first and second bar attachment points, each of the first and second bar attachment points adapted to connect to either of the first and second strut attachment points;

wherein the first and second struts when attached to the bar are positioned substantially horizontally outwards and at substantially right angles from the bar;

when the first strut attachment point of the first strut is connected to the bar at the first bar attachment point and the second strut attachment point of the second strut is connected to the bar at the second bar attachment point, the first mounting plate is disposed at a first distance from the second mounting plate; and when the first strut attachment point of the first strut is connected to the bar at the second bar attachment point and the second strut attachment point of the second strut is connected to the bar at the first bar attachment point, the first mounting plate is disposed at a second distance from the second mounting plate, which second distance is greater than the first distance.

17. The adjustable mount pull-up bar of claim 16, wherein the linear offsets of the first and second struts are configured as curved inflections along the lengths of the first and second struts.

18. The adjustable mount pull-up bar of claim 16, wherein the linear offsets of the first and second struts are configured as angular bends along the lengths of the first and second struts.

19. The adjustable mount pull-up bar of claim 16, wherein the first distance between the mounting plates is configured to match a first standardized distance between wall studs.

20. The adjustable mount pull-up bar of claim 16, wherein the second distance between the mounting plates is configured to match a second standardized distance between wall studs, which second standardized distance is greater than the first standardized distance.

* * * * *